US005915304A

United States Patent [19]

Stiel

[11] Patent Number: 5,915,304

[45] Date of Patent: Jun. 29, 1999

[54] DEVICE FOR GUIDING FRESHLY COATED SHEETS

[75] Inventor: Jürgen Alfred Stiel, Thüngen, Germany

[73] Assignee: Koenig & Bauer-Albert Aktiengesellschaft, Wurzburg, Germany

[21] Appl. No.: 08/696,850

[22] PCT Filed: Mar. 1, 1995

[86] PCT No.: PCT/DE95/00260

§ 371 Date: Aug. 30, 1996

§ 102(e) Date: Aug. 30, 1996

[87] PCT Pub. No.: WO95/23701

PCT Pub. Date: Sep. 8, 1995

[30] Foreign Application Priority Data

Mar. 3, 1994 [DE] Germany ..... 44 06 844

[51] Int. Cl.[6] ..... B41F 1/28

[52] U.S. Cl. ..... 101/416.1; 101/419; 271/195

[58] Field of Search ..... 101/416.1, 419, 101/420, 233, 232, 483, 229; 271/195, 194

[56] References Cited

U.S. PATENT DOCUMENTS

| | | | |
|---|---|---|---|
| 2,268,988 | 1/1942 | Hess et al. | 101/416.1 |
| 2,797,074 | 6/1957 | Flynn | 101/416.1 |
| 3,633,281 | 1/1972 | Vits | 34/259 |
| 3,975,057 | 8/1976 | Hurd | 271/195 |
| 3,979,038 | 9/1976 | Karlsson | 242/615.51 |
| 5,634,636 | 6/1997 | Jackson et al. | 271/195 |
| 5,687,964 | 11/1997 | Stephan et al. | 271/195 |
| 5,797,327 | 8/1998 | Gieser et al. | 271/195 |

FOREIGN PATENT DOCUMENTS

| | | |
|---|---|---|
| 0 364 425 | 4/1990 | European Pat. Off. . |
| 2 272 932 | 12/1975 | France . |
| 1 449 656 | 11/1968 | Germany . |
| 1 907 083 | 9/1970 | Germany . |
| 34 43 704 | 6/1986 | Germany . |
| 34 11 029 | 10/1987 | Germany . |

*Primary Examiner*—Edgar Burr
*Assistant Examiner*—Anthony H. Nguyen
*Attorney, Agent, or Firm*—Jones, Tullar & Cooper, P.C.

[57] ABSTRACT

A device for guiding freshly coated sheets utilizes upper and lower air supply chambers which are both connected to a blower through supply conduits and a return conduit. An arrangement of throttle valves is used to connect one of the air supply conduits to either the discharge or the return side of the blower. This allows the device to operate in two modes, a support mode and a suction mode.

5 Claims, 3 Drawing Sheets

DEVICE FOR GUIDING FRESHLY COATED SHEETS

FIELD OF INVENTION

The present invention relates to a device for guiding freshly coated sheets over a continuous guidance surface in a processing machine.

DESCRIPTION OF THE PRIOR ART

A blowing chamber for the suspended guidance of sheets is known from DE-PS 19 07 083, in which blower openings with a downward extending guide surface are provided. The sheet is guided to an air cushion by air jets emerging from these blower openings. It is disadvantageous here that this device cannot be charged with suction air and that no directed jet can be generated by means of these nozzles.

DE-PS 34 11 029 describes a continuous guide surface with air nozzles embodied as bores. The air nozzles can be selectively operated as blower or suction nozzles. It is disadvantageous in connection with these nozzles that no suction effect is generated during the blowing operation and no directed force for stretching the sheet can be generated.

Neither of the two embodiments in the prior art have a device which clamps a sheet at its top by means of a second air cushion and by means of which drying of the sheet can take place.

DE-PS 34 43 704 discloses a conveying device for sheets which has two guide surfaces arranged one on top of the other. These guide surfaces are provided with bores which are used as air nozzles. The sheet is clamped between two air cushions. It is disadvantageous in this case that the sheet floats between these air cushions in an undefined position and tends to flutter easily.

These air nozzles are served by a large number of blowers, which requires a large control and installation outlay.

DE-PS 14 49 656 describes a device for the flutter-free guidance of flat materials. Here, blowing chambers provided with slit nozzles are provided for guiding the flat materials, opposite of which blowing chambers with perpendicularly emerging blowing jets are arranged for drying.

It is disadvantageous here that no continuous guide surface is provided and therefore the flat materials tend to form waves. Furthermore, the energy outlay for guiding the sheets is high in use with sheets only printed on one side.

SUMMARY OF THE INVENTION

It is the object of the present invention to create a device for guiding freshly coated sheets along a guidancee surface in a processing machine, preferably a rotary printing press, with selectively two modes of operation. In a first mode of operation, "support air and drying operation", an air supply chamber of the guidancee surface and an air supply chamber for impact jet nozzles can be charged with compressed air. In a second mode of operation, "suction air and drying operation", the energy requirements and therefore the operating costs of the device in accordance with the invention can be considerably reduced in comparison with the prior art without greatly affecting drying.

This object is attained in accordance with the invention by providing a device that is used in a processing machine, such as a rotary printing press, to guide sheets over a guidance surface or a first air supply chamber that is provided with slit nozzles. Each slit nozzle has an oblique guide surface extending downward into the guidance surface. A second air supply chamber is located opposite to the first air supply chamber. This second air supply chamber has impact jet nozzles directed toward the guidance surface The device is operable in either of two modes. In a first mode which is a "support air and drying operation" a stable air cushion is formed between the sheets and the guidance surface by charging the first air supply chamber with compressed air. In a second mode of operation, which is a "suction air and drying operation" the first air supply chamber is charged with compressed air so that the slit nozzles act as suction nozzles. The first and second air supply chambers are charged with a common air supply provided by a blower which provides an approximately constant air pressure over changing volume flow and whose power consumption is approximately equal to the conveyed amount.

The advantages which can be achieved by means of the present invention reside in particular in that in addition to a first mode of operation—the support air and drying operation—a second mode of operation—the suction air and drying operation—of the device in accordance with the present invention is possible, wherein the energy requirements of the device in accordance with the present invention are considerably reduced in comparison with the first mode of operation and with the prior art. The support air operation is suitable for the suspended guidance of sheets whose side facing the guidance surface is printed or has a delicate surface, for example where the sheet surface is coated with aluminum.

If the side of the sheet facing the guidance surface is of subordinate importance, for example if it is not printed, the sheet is aspirated against the guidance surface during suction air operation. Because of this, there is no requirement for blowing air for the guidance surface anymore, because of which considerable energy savings are possible.

The amount of air for the blowing chamber with its impact jet nozzles is only slightly changed by the switching between the two modes of operation.

It is possible to create a defined sheet guide plane by means of the combination of the suspended guidance and the blowing chamber with impact jet nozzles (impact jet dryer), so that the sheet can be guided at a small distance from the guidance surface. Impact jet nozzles are employed in an advantageous manner, since they display good drying effects even at a larger distance. Because of this, it is possible to arrange the blowing chamber with the impact jet nozzles and the guidance surface at a large distance, so that the sheets can be moved in an advantageous manner by means of chain conveyors.

BRIEF DESCRIPTION OF THE DRAWINGS

The device in accordance with the present invention is represented in the drawings and will be described in more detail below.

DETAILED DESCRIPTION OF THE PREFERRED EMBODIMENT

Figure 1:
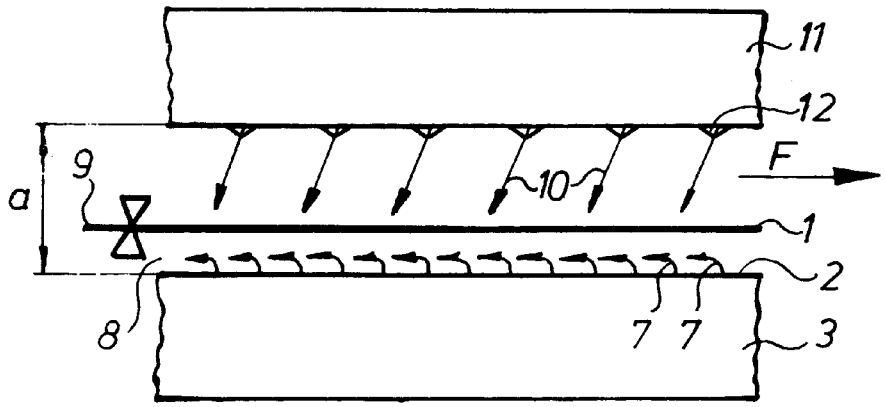
FIG. 1, is a schematic view of the device in accordance with the present invention along the conveying direction.
Figure 2:
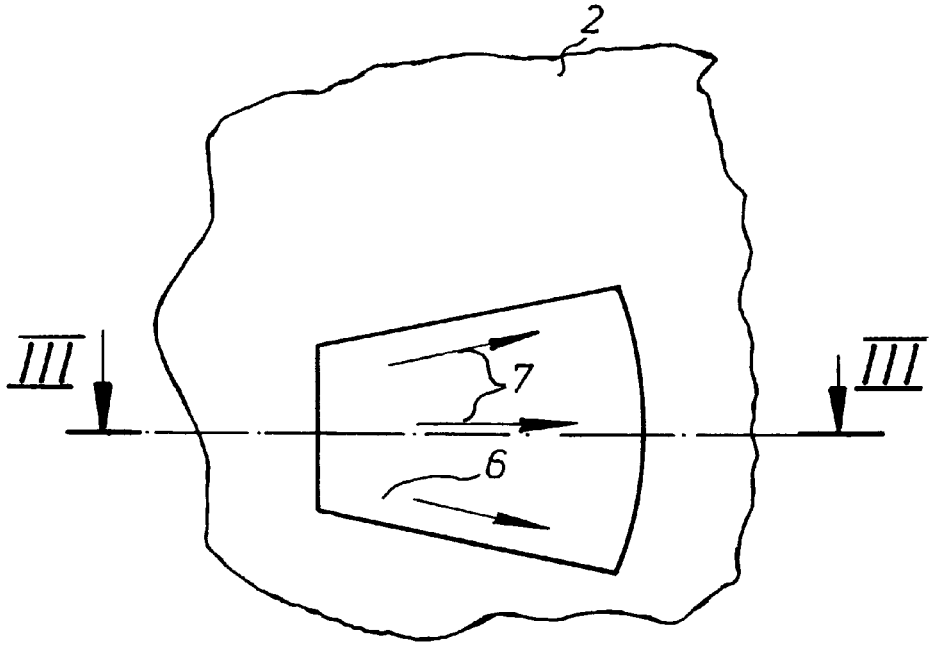
FIG. 2, is a portion of a guidance surface with a slit nozzle in a top view.
Figure 3:
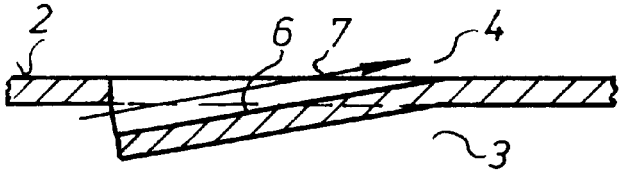
FIG. 3, is a sectional view of the portion shown in FIG. 2, FIG. 4, is a schematic sectional view transversely to the conveying direction of the device in accordance with the invention during the support air and drying operation, and FIG. 5, the portion represented in FIG. 2 during the suction air and drying operation.
Figure 4:
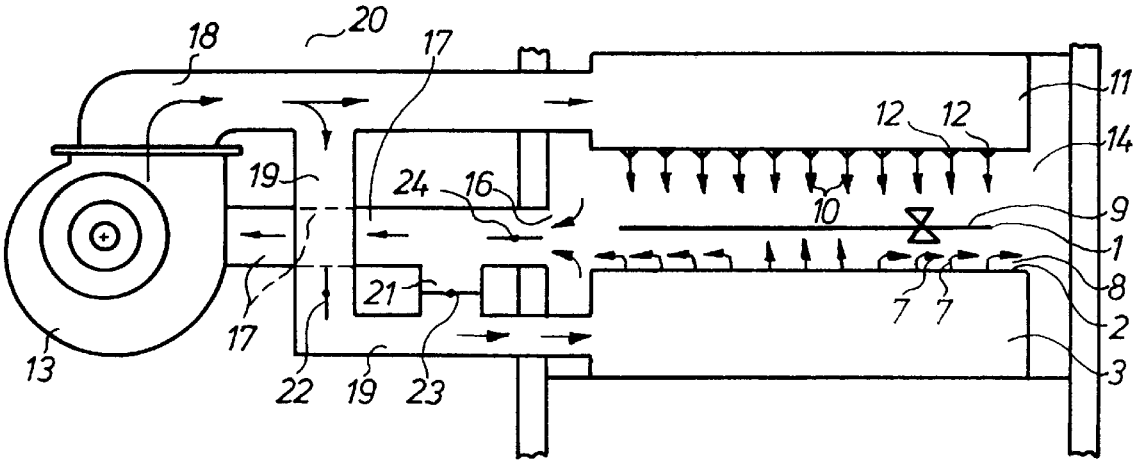
Figure 5:
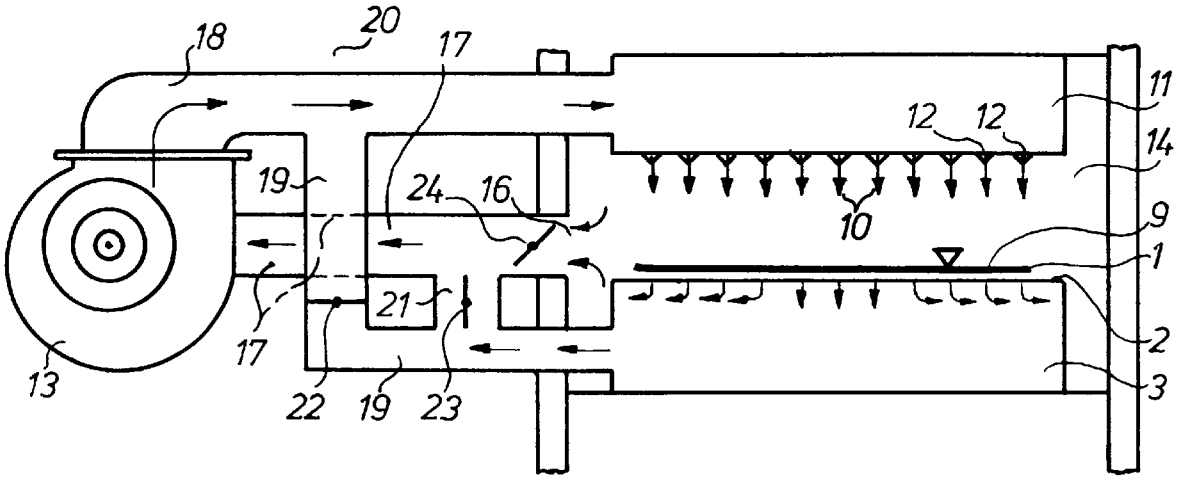

In accordance with FIG. 1, sheets 1 or webs are conveyed in a processing machine, for example a rotary printing press, along an enclosed guidance surface 2. This enclosed guidance surface 2 is an upper part of a first or lower air supply chamber 3 and is provided with a plurality of slit nozzles 4, which have an air guide surface 6 which extends obliquely downward into the guidance surface 2, as seen in FIG. 2 and FIG. 3. When this air supply chamber 3 is provided with blowing air, these slit nozzles 4 each generate an air jet 7 diverging in width, which extends along the guidance surface 2, i.e. which flows on the guidance surface 2. An air cushion 8 is generated on the guidance surface 2 by these air jets 7 which supports and aspirates the sheets 1 by means of a simultaneous blowing/suction effect, a so-called hydrodynamic paradox. A second or upper air supply chamber 11 is disposed respectively facing a freshly printed upper page surface 9 of the sheets 1 and is located opposite the guidance surface 2 at a distance a of, for example, 100 mm. This which is supplied with impact jet nozzles, whose air jets 10 impact approximately perpendicularly on the freshly printed side 9 of the sheet 1 and dry it. The air required for these two air supply chambers 3 and 11 is accelerated by a centrally located common blower 13, as shown in FIGS. 4 and 5. These two air supply chambers 3, 11 are disposed, as can also be seen in FIGS. 4 and 5 in an almost enclosed space 14, which only has respective openings at the front for the passage of the sheets. Air for a suction or return conduit 17 of the blower 13 is removed at a central point 16 of the enclosed space 14, for example, at the center of its left side via an opening 16. The air is accelerated in the blower 13 in such a way that following the exit from the blower 13, an overpressure of air of selectively 500 Pa to 2000 Pa is created. Following the exit from the blower 13, a short blow-out upper air chamber supply conduit 18 leads to the upper air supply chamber 11 of the impact jet nozzles 12 in order to keep the flow losses low, so that approximately 500 Pa to 2000 Pa are also selectively available. A lower supply conduit 19 for the lower air supply chamber 3 of the guidance surface 2 branches off this blow-out conduit 18. This lower supply conduit 19 is connected via a connecting conduit 21 with the suction or return conduit 17 of the blower 13. In this way, the air supply chamber 3 for the slit nozzles 4 and the air supply chamber 11 for the impact jet nozzles 12 have a common air supply 20, which consists of the blower 13, the suction or return conduit 17, the upper or blow-out conduit 18, the lower supply conduit 19 and the connecting conduit 21.

A first selectively adjustable throttle device 22 is located in the lower supply conduit 19 between the connecting conduit 21 and the blow-out conduit 18. A further or second selectively adjustable throttle device 23 and 24 is respectively disposed in the connecting conduit 21 as well as in the suction or return conduit 17 between the opening 16 and the connecting conduit 21.

In a first mode of operation—the support air and drying operation—of the device in accordance with the invention, as is depicted in FIG. 4 the slit nozzles 4 of the guidance surface 2 are charged from below with compressed air and the sheets 1 are supported in this way on an air cushion 8.

To this end, the supply conduit 19 of the first or lower air supply chamber 3 is connected with the blow-out conduit 18 of the blower 13, and the connecting conduit 21 to the suction conduit 17 is closed. This is accomplished by opening the throttle device 22 and closing the throttle device 23. By varying the opened position of the throttle device 22 by means of positioning drives, not shown, for example positioning devices being remote controlled and having an electric motor drive, the air pressure of, for example, 200 Pa in the air supply chamber 3 of the slit nozzles 4 may be changed. The throttle device 24 in the suction conduit 17 is fully open. In the present invention the throttle devices 22, 23, 24 are embodied as adjustable flaps and are moved by means of pneumatic cylinders, not shown. The opened position is predetermined by means of an adjustable stop. If the air pressure in the air supply chamber 3 is intended to be variable, it is possible to employ known positioning devices or control devices such as servo motors or servo cylinders, which either move into a defined position or are controlled by means of a pressure sensor.

If the slit nozzles 4 of the guidance surface 2 are charged with suction air, for example 50 Pa, in a second mode of operation —the suction air and drying operation—, as depicted in FIG. 5 the supply conduit 19 is connected with the suction conduit 17 by opening the throttle device 23, and the connection with the blow-out conduit 18 is closed by shutting the throttle device 22, which is accomplished by means of the described positioning drives. By means of this, the amount of air conveyed by the blower 13 is reduced by the amount of the blowing air no longer supplied to slit nozzles 4 of the guidance surface 2 in comparison with the support air and drying operation, so that because of this the power consumption of the blower 13 is reduced.

In order to keep the desired amount of blowing air of the impact jet nozzles 12 constant in both the support air and the suction air operation, the underpressure or suction in the air supply chamber 3 is set by means of the throttle device 23, and the amount of air in the air supply chamber 11 is controlled by means of the throttle device 24. To insure that the air pressure remains approximately constant during the control of the amount of air via the throttle devices 22, 23, and 24, a blower 13 is preferably employed whose characteristic line shows an approximately constant pressure with changing conveyed amounts. In this case, the power consumption of the blower 13 is proportional to the conveyed air amount. A blower 13 with a total pressure increase of 1000 to 3000 Pa is suitable for the assured operation of the device in accordance with the invention. These properties are met, for example, by a compressor drum radial blower.

While a preferred embodiment of a device for guiding freshly coated sheets in accordance with the present invention has been set forth fully and completely hereinabove, it will be apparent to one of skill in the art that a number of changes in, for example, the type of printing press used, the type of sheet or web being guided, the overall size of the device and the like could be made without departing from the true spirit and scope of the present invention which is accordingly to be limited only by the following claims.

I claim:

1. A device for guiding sheets in a processing machine, such as a rotary printing press comprising:

a first air supply chamber having a sheet guidance surface provided with slit nozzles, each of said slit nozzles having an oblique guide surface extending downward in said guidance surface;

a second air supply chamber located opposite said first air supply chamber and having impact jet nozzles, said jet nozzles directed toward said guidance surface;

means for selectively supplying air to, and removing air from, said first air supply chamber and for supplying air to said second air supply chamber, said means including a blower, and means for selectively operating said device in a first, support air and drying operation mode in which said first and second air supply chambers are supplied with air from said blower, and in a second, suction air and drying operation mode in which air is removed from said first air supply chamber whereby said slit nozzles act as suction nozzles, said blower supplying an approximately constant air pressure with changing air volume flow and having a power consumption approximately proportional to an amount of air conveyed.

2. The device of claim 1 further including an air supply conduit for said first air chamber and blower air supply conduit and blower air return conduits on said blower, said first air chamber air supply conduit being selectably connected to said blower air supply conduit and said blower air return conduit.

3. The device of claim 2 further including adjustable throttle devices positioned in said air supply conduit for said first air chamber and in said blower air return conduit.

4. The device of claim 1 further including a blower air return conduit and a throttle in said blower air return conduit.

5. The device of claim 1 wherein said blower is a compressor drum radial blower.

* * * * *